US006429579B1

(12) United States Patent
Pastir et al.

(10) Patent No.: US 6,429,579 B1
(45) Date of Patent: Aug. 6, 2002

(54) APPARATUS AND METHOD OF LEAD CENTERING FOR HALOGEN/ INCANDESCENT LAMPS

(75) Inventors: John T. Pastir, Eastlake; Ronald J. Olwert, Concord Township, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/281,414

(22) Filed: Mar. 30, 1999

(51) Int. Cl.[7] ..... H01J 1/88; H01J 19/42

(52) U.S. Cl. ..... 313/279; 313/238; 313/271

(58) Field of Search ..... 313/238, 271, 313/272, 273, 274, 275, 276, 278, 279, 285, 284, 569, 578, 579; 445/32, 48

(56) References Cited

U.S. PATENT DOCUMENTS 3,982,145 A * 9/1976 Loptow ..... 313/274
4,017,758 A 4/1977 Almer et al.
4,626,735 A * 12/1986 Morris et al. ..... 313/275
4,652,789 A 3/1987 Kawakatsu et al.
4,663,557 A 5/1987 Martin, Jr. et al.
4,701,663 A 10/1987 Kawakatsu et al.
4,812,710 A * 3/1989 Klam et al. ..... 313/579
4,942,331 A 7/1990 Bergman et al.
5,374,872 A 12/1994 Balaschak et al.
5,565,734 A * 10/1996 Pinot ..... 313/578
5,578,892 A * 11/1996 Whitman et al. ..... 313/112

* cited by examiner

*Primary Examiner*—Vip Patel
*Assistant Examiner*—Karabi Guharay
(74) *Attorney, Agent, or Firm*—Fay, Sharpe, Fagan, Minnich & McKee, LLP

(57) ABSTRACT

A method and apparatus for more precisely centering lamp leads (32, 34) uses a support mechanism (50) for radially aligning the leads. The support mechanism is a helical member having first and second helical portions (52, 54). The first helical portion has a diameter slightly less than the inner diameter of the lamp envelope to maintain a filament (30) on axis. The second helical portion has an outside diameter less than the outside diameter of the first helical portion for securing the support mechanism to a mounting mechanism (60). Here, the mounting mechanism is preferably defined by first and second flattened portions (62, 64) integrally formed on the lead that axially positions the support mechanism in place.

13 Claims, 2 Drawing Sheets

APPARATUS AND METHOD OF LEAD CENTERING FOR HALOGEN/ INCANDESCENT LAMPS

BACKGROUND OF THE INVENTION

1. Field of the Invention

The present invention pertains to an apparatus and method for centering first and second leads in an incandescent lamp. More particularly, the invention relates to a device for centering the leads of an incandescent lamp wherein a support mechanism, operatively associated with the leads, radially aligns the leads and improves lamp performance.

2. Discussion of the Prior Art

A conventional double ended filament lamp is well known by those in the art. The lamp has a vitreous envelope enclosing a filament wherein the envelope is hermetically sealed at both ends. These lamps are generally constructed of a quartz tube or a suitable high temperature glass, such as an aluminosilicate glass, which forms a filament chamber that encloses an elongated filament. In these lamps, the filament is mounted axially along the length of the lamp within the filament chamber by inleads which are hermetically sealed at the ends of the lamp. The filament chamber generally contains one or more inert fill gases and may be coated with a thin film or filter. The thin film or filter transmits visible light radiation and reflects infrared radiation to the filament which decreases the amount of electrical power used by the lamp without impacting visible light output.

Incandescent lamps which transmit the visible light portion of the filament while at the same time reflecting infrared radiation emitted by the filament to the filament may be found in U.S. Pat. Nos. 4,017,758; 4,652,789; 4,663,557; and 4,701,663. For example, light interference filters made up of tantala and silica may be employed on the surface of a vitreous filament chamber for selectively reflecting infrared radiation emitted by the filament while at the same time preferentially transmitting radiation in the visible portion of the electromagnetic spectrum. In these types of filters the infrared radiation is reflected by the filter or coating to the filament wherein at least a portion is reconverted to light radiation, thereby greatly increasing the efficiency of the lamp. Such lamps require precise radial alignment of the leads and filament along the optical center of the filament chamber in order to achieve maximum conversion of the infrared radiation to visible light radiation which is transmitted by the filter.

The filament of double ended lamps operates at high temperatures and creates a high temperature atmosphere around the filament. Double ended lamps having Molybdenum foils cannot operate in oxidizing atmospheres for extended periods of time at high temperatures (≧350 C.) without the foils oxidizing. This oxidation forces open the seal in the lamp causing the lamp to fail. Oftentimes, to reduce the temperature of the seal, a long inner lead is used to position the filament further from the lamp seal thereby reducing the temperature of the seal. However, as the leads get longer, any bow in the lead material could force the filament off the center of the lamp axis. The leads are especially prone to bowing and coming closer to the filament chamber wall during the sealing process. These consequences may result in over heating of the wall of the filament chamber which can have a detrimental effect on the output of an optical system that this lamp could be used in. In addition, if the filament is not located at the optical center of the filament chamber, then a substantial portion of the infrared radiation reflected by the filter will miss the filament and strike the other side of the filament chamber. As a practical matter, all coatings or filters that reflect infrared radiation also transmit a small fraction of the radiation striking the filter. Thus, a substantial portion of infrared radiation which undergoes multiple reflections before encountering the filament can be lost through the filter before being converted into visible light radiation. This weakens the performance of the lamp. To maintain the integrity of the lamp, the leads and filament must be sufficiently stable to ensure the leads and the filament remain centered on the lamp axis.

By way of example, U.S. Pat. No. 4,942,331, Bergman et. al., assigned to the assignee of the present invention, illustrates a spud, for centering a filament in an incandescent lamp. This patent is useful in lamps with leads of traditional length. However, as leads get longer the use of spuds alone does not adequately center the leads and filament. With longer leads, additional support is needed to stabilize the leads and filament. Still another means for centering the leads and filament is illustrated in U.S. Pat. No. 5,374,872, Balaschak et al., assigned to the assignee of the present invention. However, when used in conjunction with longer leads this patent alone also does not adequately center the leads and filament.

The present invention contemplates a new and improved apparatus and method for centering leads along the lamp axis. The present invention provides a device that enables one to achieve precise centering of the light generating means to increase the performance and maximize the efficiency of light transmission in double ended light sources. The subject invention can be used in conjunction with other support mechanisms, such as those stated in the foregoing patents, to further improve the stability of longer leads and the filament.

SUMMARY OF THE INVENTION

A new and improved apparatus and method is provided for centering the filament and inleads along the lamp axis of a double ended light source.

In an exemplary embodiment of the invention, a lamp includes a hollow tubular envelope formed from light transmissive material which defines a chamber having a longitudinal axis. The filament is generally aligned in the chamber along the lamp axis. The lamp further includes first and second leads which extend outwardly from opposing ends of the filament with at least one of the leads having a mounting portion. At least one support mechanism, for centering the filament along the lamp axis, is operatively associated with at least one of the leads. In addition, first and second foils are secured to the outer ends of the leads and form a seal with the envelope.

The mounting portion includes a flattened portion for securing the support mechanism in place, and preferably first and second flattened portions for locking the support mechanism in place on the lead. The first flattened portion is positioned at the inner end of one of the leads and engages the filament. The second flattened portion is positioned a predetermined dimension away from the first flattened portion. The support mechanism is secured between the first and second flattened portions.

In carrying out the method of the present invention for centering first and second leads, the steps include (a) winding an elongated support mechanism around one of the leads, (b) forming a mounting portion from one of the leads, and (c) attaching the inner ends of the leads to the filament.

The elongated metal material is wound to form a first helix. The elongated metal is further wound to form a second helix with a diameter less than the first helix.

The mounting portion is formed from flattening at least one area of the lead. The support mechanism is secured in place by at least one flattening portion. Preferably, two flattening portions are formed from each of the leads and the support mechanism is secured in place between the two flattened portions.

A principal advantage of the subject invention is found in the support mechanism and mounting portion which work together to better maintain the filament along the lamp axis and improve the stability of longer leads.

Another advantage of the invention resides in its ability to work together with conventional support mechanisms to improve the stability of longer leads.

Yet another advantage of the invention is found in the reduced labor costs of manufacturing and operation of the lead and filament centering apparatus.

Still other advantages and benefits of the invention will become apparent to those skilled in the art upon a reading and understanding of the following detailed description.

BRIEF DESCRIPTION OF THE DRAWINGS

The invention may take a physical form in certain parts and arrangements of parts, a preferred embodiment and method of which will be described in detail in this specification and illustrated in the accompanying drawings which form a part hereof and wherein.

DETAILED DESCRIPTION OF THE PREFERRED EMBODIMENTS

Figure 1B:
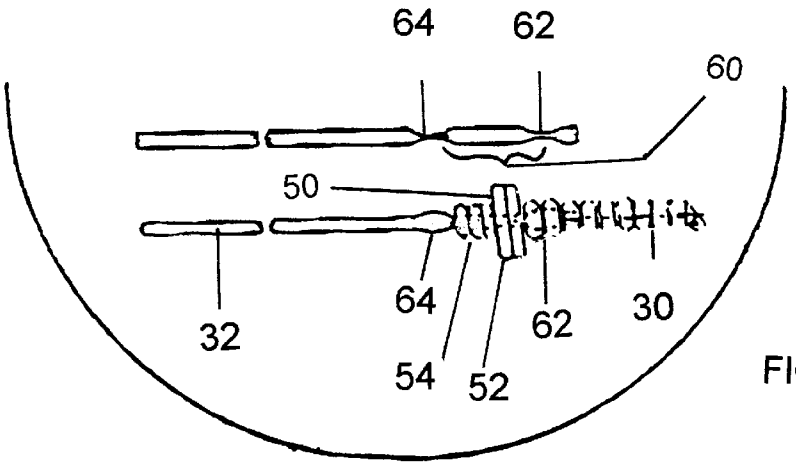
FIG. 1 is an elevational view through an incandescent lamp embodying one form of the invention.
Figure 1A:
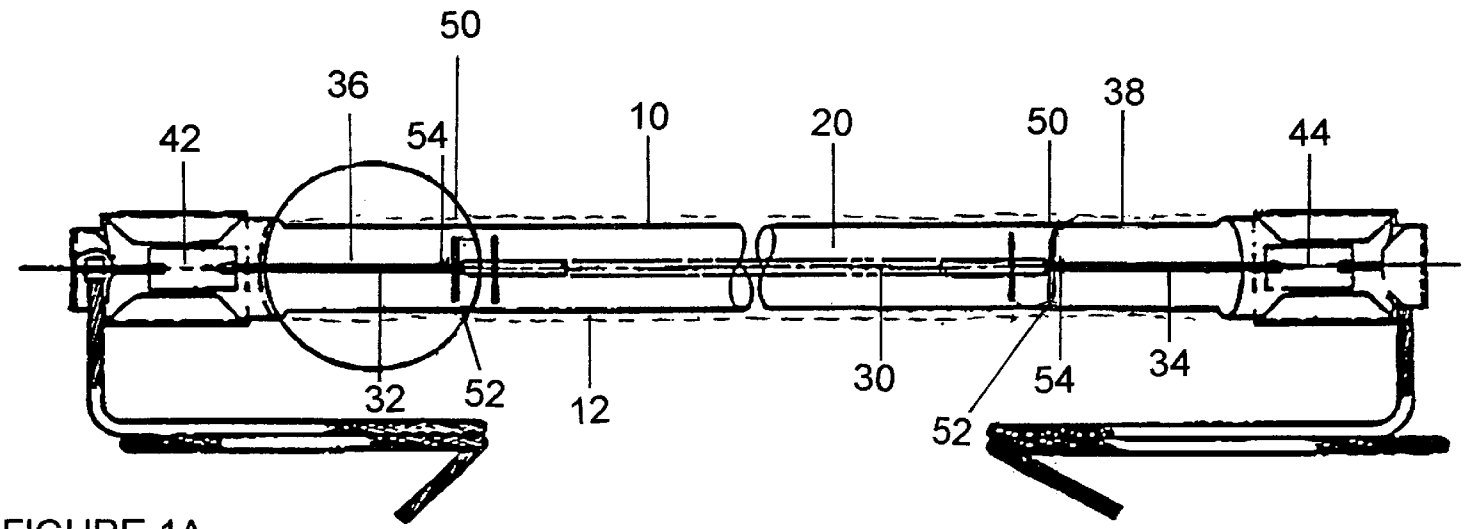

Referring now to the drawings wherein the showings are for the purposes of illustrating the preferred embodiment of the invention only and not for purposes of limiting same, FIG. 1 shows a lamp A comprising a tubular envelope 10 of vitreous light-transmitting material, such as fused quartz. It should be noted that any suitable high temperature glass, such as an aluminosilicate glass, can be used to form the tubular envelope 10. The tubular envelope 10 preferably has a coating or filter 12 on its outer surface which reflects infrared radiation and transmits visible light radiation. The tubular envelope 10 has a longitudinal axis and defines a filament chamber 20. The filament chamber encloses a filament 30 radially aligned along an optical center of the filament chamber 20. First and second leads 32, 34 extend outwardly from opposing ends of the filament 30 along the central axis of the tubular envelope 10. A pair of spuds 36, 38 are operatively associated with leads 32, 34, respectively, for assisting to center the leads 32, 34 and the filament 30 along the lamp axis. U.S. Pat. No. 4,942,331 discloses a patent incorporating spuds of the type discussed herein. The outer ends of the leads 32, 34 are joined with foil members 42, 44 through conventional joining methods.

The foil members 42, 44 are made of suitable refractory metal wire such as molybdenum, tungsten and the like. Molybdenum is preferred because of its electrical properties and formability characteristics. Both ends of the tubular envelope 10 are sealed to the foil members 42, 44 to form a hermetic seal between the envelope 10 and the foil members 42, 44. It will be obvious to those skilled in the art that the seal may be achieved by pinching, pressing or shrinking the tubular envelope 10 over the foil members 42, 44. Seals that are not particularly prone to deformation and misalignment of the components of the lamp A are preferred.

The coating 12 is preferably made up of alternating layers of a low refractory index material such as silica and a high refractory index material such as tantala, titania, niobia and the like for selectively reflecting and transmitting different portions of the electromagnetic spectrum emitted by the filament 30. In a preferred embodiment of the invention, the filter will reflect infrared radiation toward the filament and transmit the visible portion of the spectrum. The filament chamber 20 contains inert gas such as argon, xenon or krypton along with minor (i.e., less than 10%) amounts of nitrogen, and may contain one or more halogen compounds such as methyl bromide, dibromomethane, dichlorobromomethane and the like.

Figure 2:
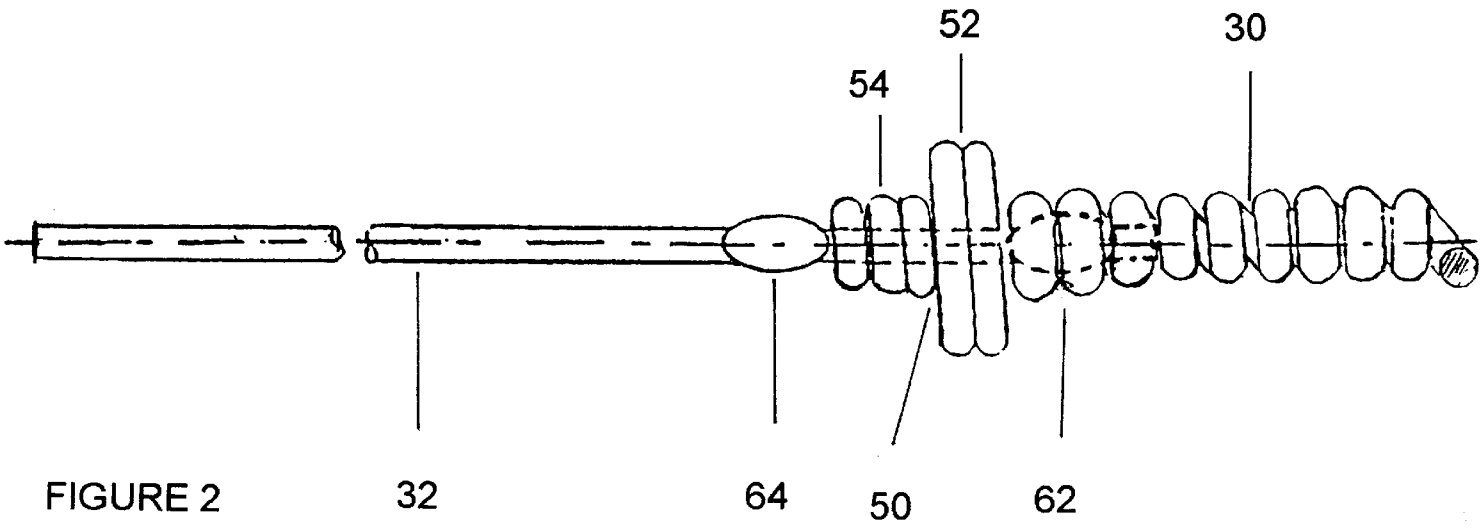
FIG. 2 is a top plan view of a lead-centering apparatus which constitutes a part of the lamp of FIG. 1.

FIG. 2 illustrates a support mechanism 50 of the present invention preferably made from a refractory metal wire and operatively associated with the first lead 32. The support mechanism is designed to slide over the lead 32 and provide support to the lead 32 and filament 30 so that they are maintained along the lamp central axis. Support mechanism 50 takes a helical or coiled form and is wound with an outside diameter less than the inside diameter of the tubular envelope 10 and an inside diameter greater than the outside diameter of the lead 32. Support mechanism 50 is positioned on the inner end of the lead 32 and is adjacent to one end of the filament 30. The support mechanism 50 includes a first and second helix 52, 54, respectively, which wind around the lead 32 and are designed to maintain the lead 32 and filament 30 along the lamp central axis. The first helix 52 is wound approximately one and a half turns and has a diameter greater than the second helix 54. The second helix 54 extends from the first helix 52 and continues to wind toward the outer end of the lead 32 with a diameter approximately 0.002 inches greater than the outside diameter of the lead 32. The helical portion 52 prevents substantial radial movement of the leads, and thus the filament, during assembly and operation of the lamp. The smaller diameter winding or helical portion 54 is useful in securing the support mechanism in place. It will be obvious to those skilled in the art that the support mechanism 50 can achieve similar results using any number of helixes, wound any number of turns.

Figure 3:
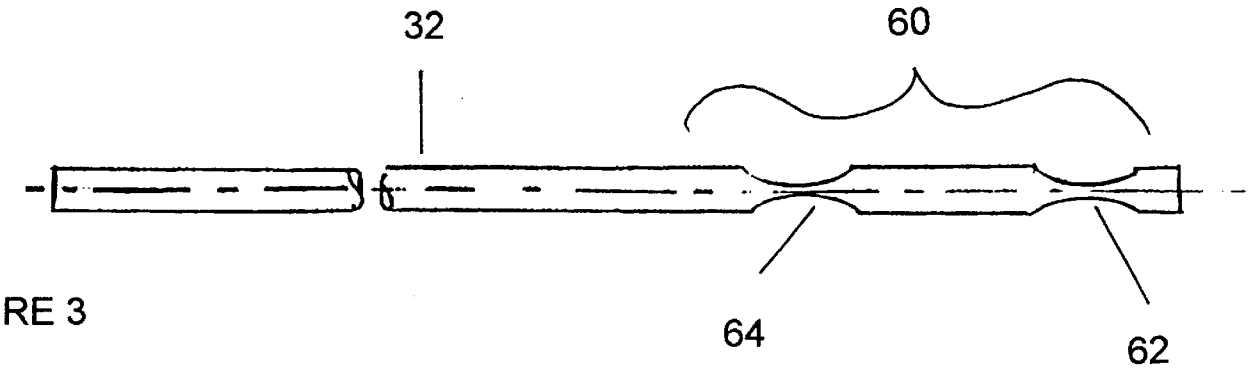
FIG. 3 is a side elevational view of the flattened portions of a lead which constitutes a part of the lamp in FIG. 1.

A mounting portion 60 formed from the first lead 32 which is designed to secure the support mechanism 50 in place along the lead 32 (FIG. 3). The mounting portion is constructed by flattening two portions of the lead 32 to form first and second flattened portions 62, 64. It will be obvious to one skilled in the art that any number of flattened portions can be used to secure the support mechanism 50 in place. In the present invention, however, the support mechanism 50 is positioned between the two flattened portions 62, 64 thereby axially locking the support mechanism 50 in place. The first flattened portion 62 is formed and positioned at the inner end of the lead 32 and has a diameter greater than the inside diameter of the support mechanism 50. The support mechanism is slid over the lead 32 until the first helix 52 is adjacent to the first flattened portion 62. The second flattened portion 64 of the lead is then formed and positioned a predetermined dimension away from the first flattened portion 62 so that the second helix 54 of the support mechanism 50 is adjacent to and inside of the second flattened portion 64. Since the diameters of the first and second flattened portions 62, 64 are greater than the inside diameters of the first and second helix

52, 54 the support mechanism is secured in place on the lead 32. Referring again to FIG. 2, the first flattened portion of the inner lead 32 is inserted into the filament 30 so that the lead 32 is operatively associated with the filament 30. In the preferred embodiment, the support mechanism and mounting portion provide support and stability on both the first and second leads 32, 34. However, it is obvious to one skilled in the art that only one or more than one support mechanism may be provided on one or both leads to achieve the same result.

The completed lamp A of FIG. 1 shows the leads 32, 34, the mounting portion 60, and the support mechanism 50 in relation to the rest of the lamp. Thus, as is apparent, the ability to maintain the filament 30 along the lamp central axis is enhanced by the support mechanism 50 of the present invention.

The invention has been described with reference to the preferred embodiments. Obviously modifications and alterations will occur to others upon a reading and understanding of this specification. It is intended to include all such modifications and alterations insofar as they come-within the scope of the appended claims or the equivalents thereof.

What is claimed is:

1. A lamp comprising:

a hollow envelope formed from a light-transmissive material defining a filament chamber along a lamp axis;

a filament generally aligned in the chamber along the lamp axis;

first and second conductive leads extending outwardly from opposite ends of the filament substantially along the lamp axis, including a mounting portion thereon;

at least one support mechanism operatively associated with the leads for radially aligning the filament along the lamp axis, the mounting portion including a first flattened portion which secures the support mechanism in place on the first and second leads; and first and second foil members secured to outer ends of the first and second leads, the foils forming a seal with the envelope.

2. The lamp of claim 1 wherein the mounting portion includes a second flattened portion and at least the first and second flattened portions axially locking the support mechanism in place on the first and second leads.

3. The lamp of claim 2 wherein the first flattened portion is positioned at the inner end of one of the leads engaging the filament and the second flattened portion is positioned a predetermined dimension from the first flattened portion.

4. The lamp of claim 3 wherein the support mechanism is secured between the first and second flattened portions of the leads.

5. The lamp of claim 1 wherein the filament has a helical configuration and the mounting portion has a diameter greater than an inside diameter of the filament.

6. The lamp of claim 1 wherein the support mechanism is a refractory metal helical wire wound with an outside diameter less than an inside diameter of the envelope.

7. The lamp of claim 1 wherein the support mechanism includes a first helix having an outside diameter less than the inside diameter of the envelope.

8. The lamp of claim 7 wherein the support mechanism has a second helix extending from the first helix toward the outer end of the lead and has an outside diameter less than the outside diameter of the first helix.

9. The lamp of claim 8 wherein the second helix of the support mechanism has a diameter approximately 0.002 inches greater than the outside diameter of the leads.

10. A lamp, comprising:

a tubular envelope formed from a light-transmissive material defining a filament chamber having a lamp longitudinal axis;

a filament radially aligned in the chamber along the lamp longitudinal axis;

first and second conductive leads extending outwardly from opposite ends of the filament, the leads each comprising first and second flattened portions, the first flattened portion of each lead positioned at an inner end of the lead engaging the filament, the second flattened portion of each lead positioned a predetermined dimension away from the first flattened portion;

first and second support mechanisms operatively associated with the leads and positioned between the first and second flattened portions of the leads for radially aligning the filament along the lamp longitudinal axis, the support mechanisms having an inside diameter less than the diameter of the first and second flattened portions for securing the support mechanisms in place; and first and second foil members welded to the outer ends of the first and second leads, the foil members forming a seal with the envelope.

11. The lamp of claim 10 wherein the support mechanism is a refractory metal wire wound with an outside diameter less than an inside diameter of the envelope.

12. The lamp of claim 10 wherein the support mechanisms further comprise a first and second helix the first helix wound with an outside diameter less than an inside diameter of the envelope, the second helix wound with an outside diameter less than an outside diameter of the first helix.

13. A lamp comprising:

a hollow envelope formed from a light-transmissive material defining a filament chamber along a lamp axis;

a filament generally aligned in the chamber along the lamp axis;

first and second conductive leads extending outwardly from opposite ends of the filament substantially along the lamp axis, including a mounting portion thereon;

at least one support mechanism operatively associated with the leads for radially aligning the filament along the lamp axis, wherein the mounting portion has a diameter greater than a diameter of the support mechanism for securing the support mechanism in place; and first and second foil members secured to outer ends of the first and second leads, the foils forming a seal with the envelope.

* * * * *